US010274284B2

(12) United States Patent
Tedder et al.

(10) Patent No.: US 10,274,284 B2
(45) Date of Patent: Apr. 30, 2019

(54) HOLSTER DOCK ASSEMBLY

(71) Applicant: Tedder Industries, LLC, Post Falls, ID (US)

(72) Inventors: Thomas Tedder, Post Falls, ID (US); Jacob Shearer, Post Falls, ID (US)

(73) Assignee: TEDDER INDUSTRIES, LLC, Post Falls, ID (US)

( * ) Notice: Subject to any disclaimer, the term of this patent is extended or adjusted under 35 U.S.C. 154(b) by 0 days.

(21) Appl. No.: 15/725,510

(22) Filed: Oct. 5, 2017

(65) Prior Publication Data

US 2018/0100720 A1 Apr. 12, 2018

Related U.S. Application Data

(60) Provisional application No. 62/405,552, filed on Oct. 7, 2016.

(51) Int. Cl.
*F41C 33/04* (2006.01)

(52) U.S. Cl.
CPC ..... *F41C 33/041* (2013.01)

(58) Field of Classification Search
CPC ..... Y10S 224/904; Y10S 224/911; Y10S 224/912; F41C 33/041; F41C 33/045; F41C 33/006; B60R 7/14; F41A 23/18; A45F 2200/0591; A45F 5/021
USPC ..... 224/667, 672, 242–245, 904
See application file for complete search history.

(56) References Cited

U.S. PATENT DOCUMENTS 4,905,880 A * 3/1990 Cupp ..... F41C 33/0227 224/192
4,971,236 A * 11/1990 Grummet ..... F41C 33/0209 224/193
7,950,554 B2 * 5/2011 Hoffner ..... A45F 5/02 224/222
2008/0302845 A1 * 12/2008 Blechman ..... A45F 5/02 224/678
2017/0160050 A1 * 6/2017 Alfaro ..... G08B 13/14

* cited by examiner

*Primary Examiner* — Adam J Waggenspack
(74) *Attorney, Agent, or Firm* — Timberline Patent Law Group

(57) ABSTRACT

Representative implementations of devices and techniques provide a mounting dock assembly to receive and to support an implement (such as a handgun, for example) or an implement holster (such as a handgun holster, for example), in a variety of configurations. The dock assembly comprises a plurality of dock units, each dock unit including a substantially planar hard mount component having one or more guide ridges and a mounting portion for temporarily or permanently coupling the dock unit to a desired surface.

15 Claims, 8 Drawing Sheets

HOLSTER DOCK ASSEMBLY

PRIORITY CLAIM AND CROSS-REFERENCE TO RELATED APPLICATION

This application claims the benefit under 35 U.S.C. § 119(e)(1) of U.S. Provisional Application No. 62/405,552, filed Oct. 7, 2016, which is hereby incorporated by reference in its entirety.

BACKGROUND

Implements, such as tools, weapons, and the like, may be encased in a holster for protection of the implement and/or the user, while providing access to the implement. For example, a holster may allow a user to conveniently carry the implement, safely retaining the implement until needed. When the implement is to be used, the user may withdraw the implement from the holster, and then return it to the holster when finished. In some cases, such as with a handgun for example, the holster may allow the user to conceal the implement, or to conceal the fact that the user is carrying the implement.

However, it may not be desirable for the user to wear the implement and holster at all times. For example, it may be desirable to move the implement and holster from a worn position on the user to a temporary location not on the user's person for a time (such as when driving an automobile, sitting at a desk, sleeping in a bed, etc.), and still have ready and convenient access to the implement.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Figure 1A:
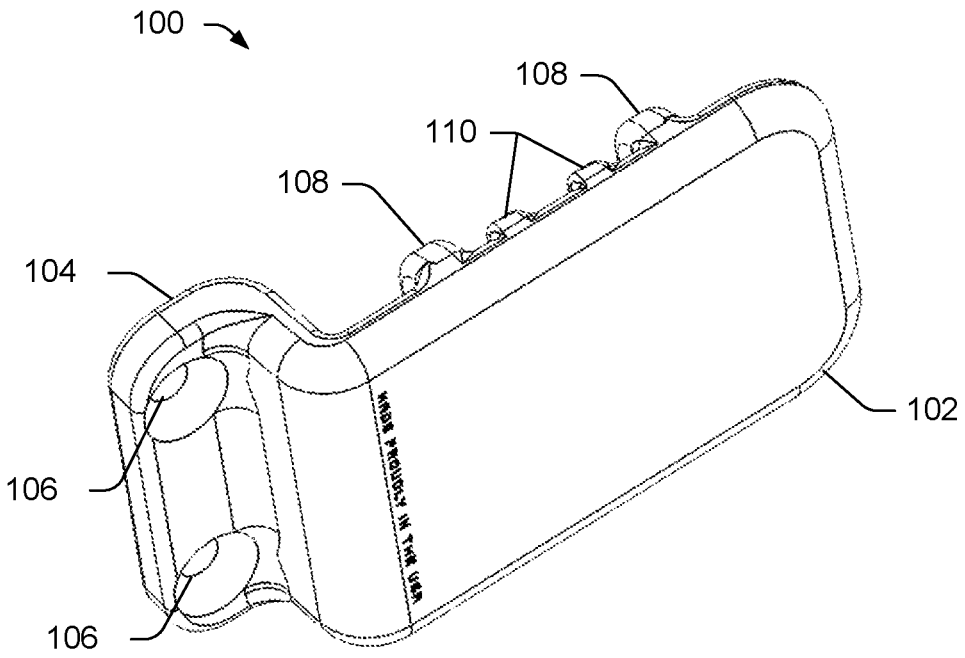
FIG. 1A shows a front perspective view of an example dock unit, according to an implementation.
Figure 1B:
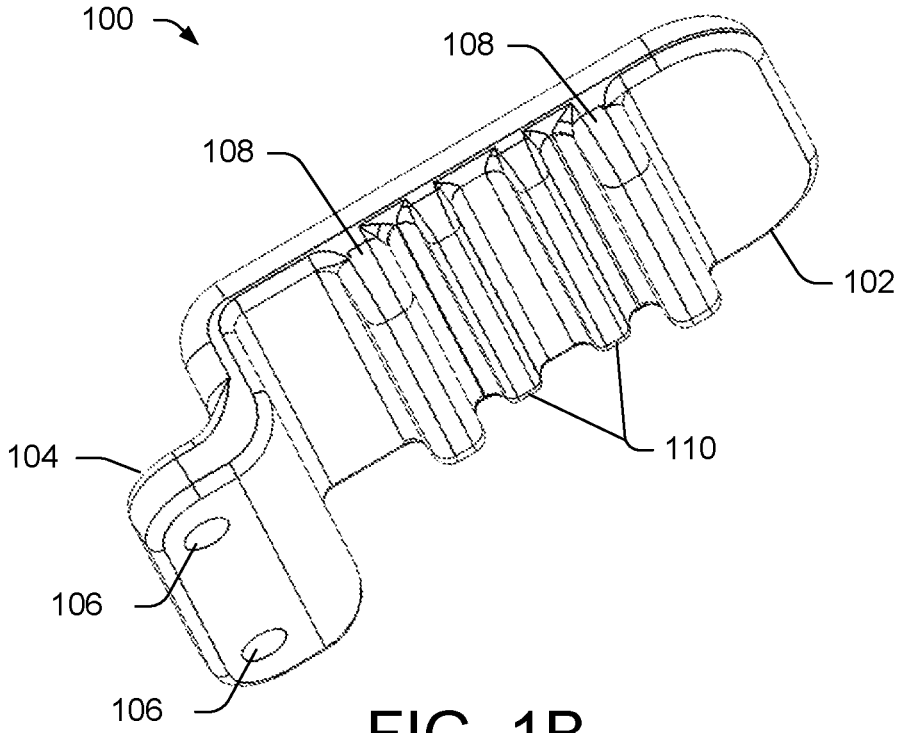
FIG. 1B shows a back perspective view of the example dock unit of FIG. 1A, according to an implementation.
Figure 2A:
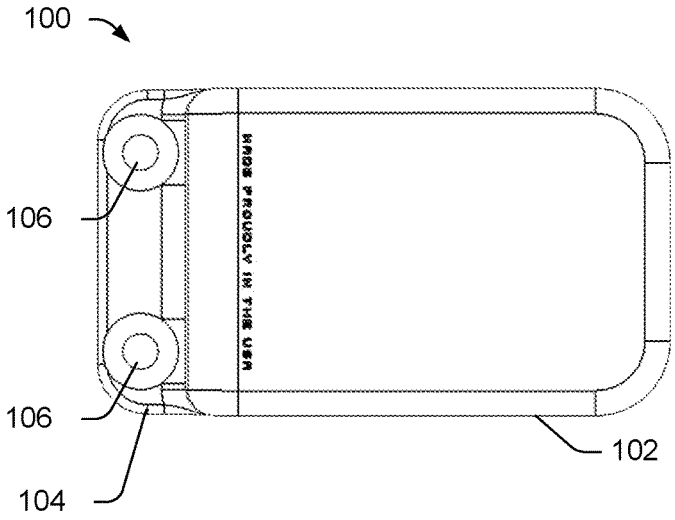
FIG. 2A shows a front (outside) view of the example dock unit of FIG. 1A.
Figure 2B:
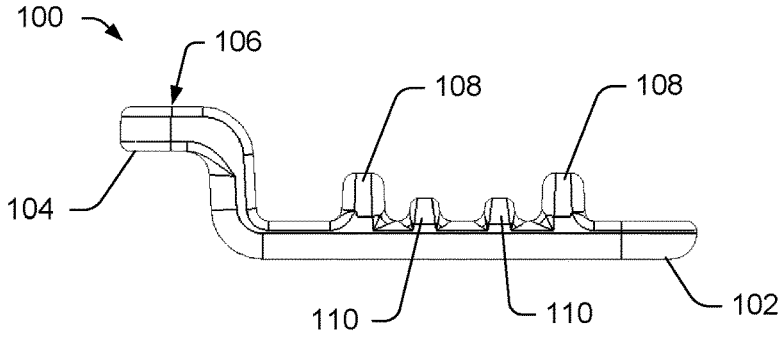
FIG. 2B shows a top view of the example dock unit of FIG. 1A.
Figure 2C:
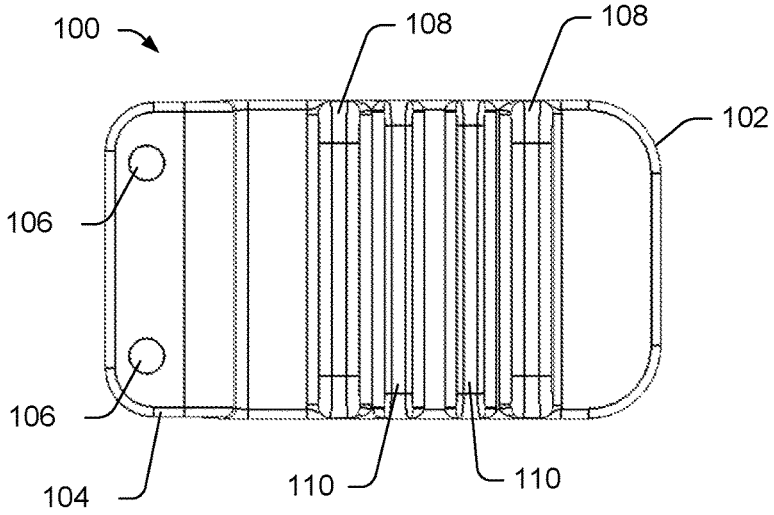
FIG. 2C shows a back (inside) view of the example dock unit of FIG. 1A.

Representative implementations of devices and techniques provide a mounting dock assembly to receive and to support an implement (such as a handgun, for example) or an implement holster (such as a handgun holster, for example), in a variety of configurations. The dock assembly (or an individual dock unit) is arranged to be mounted in various locations for temporarily and safely stowing the implement, while making the implement easily accessible to the user. For example, the dock assembly or dock unit may be mounted to a convenient surface, such as within a vehicle, on a portion of a desk or other furniture, on a bedframe, on a portion of a wall, or the like, either within view or concealed from view. The dock assembly or dock unit may be removed from one location and mounted to another location if desired, or multiple dock assemblies may be used in various locations by a user.

In various embodiments, the user can remove the implement or implement holster from their person, and mount the implement or implement holster to the dock assembly or dock unit for temporary storage with easy access. For example, when preparing to use a vehicle, the user may remove a holster from a location on the user's person, and mount the holster to the dock assembly or dock unit located inside the vehicle. The dock assembly or dock unit may be coupled to the vehicle in a convenient location, within easy reach of the user while in the vehicle. The user can easily and quickly dismount the implement or implement holster from the dock assembly or dock unit and place it on their person when desired (such as when leaving the vehicle). Alternately, the user can withdraw the implement from the holster for use while the holster remains mounted to the dock assembly or dock unit. The implement may be returned to the holster while the holster is mounted to the dock assembly or dock unit.

Techniques and devices are discussed with reference to example handgun holsters illustrated in the figures. However, this is not intended to be limiting, and is for ease of discussion and illustrative convenience. The techniques and devices discussed may be applied to a holster or to any of various cases, case designs, combinations, and the like, (e.g., holsters, sheaths, covers, cases, carriers, scabbards, etc.) for encasing tools, weapons, or other implements, and remain within the scope of the disclosure.

Further, the techniques and devices are discussed and illustrated generally with reference to an inside waistband (IWB) style holster. This is also not intended to be limiting. In various implementations, the techniques and devices may be employed with inside waistband (IWB) holsters, outside waistband (OWB) holsters, as well as holsters or cases that may be worn in various ways using a clip, belt, strap, or other article. In alternate implementations, the techniques and devices may be employed in other ways or with other devices, systems, instruments, or the like.

Implementations are explained in more detail below using a plurality of examples. Although various implementations and examples are discussed here and below, further implementations and examples may be possible by combining the features and elements of individual implementations and examples.

Example Dock Unit

As shown in FIGS. 1-8, the dock assembly 300 (or a dock unit 100) may be used with an inside the waistband (IWB) holster 402 for a handgun. The illustrations are not intended to be limiting, and the dock assembly 300 (or a dock unit 100) may be used with various other types of holsters, as well as with other implements. For this disclosure, the use of the term "holster 402" also applies to other types of holsters as well as various implements without a holster. Further, the shape and/or size of the dock unit 100 or dock assembly 300 may vary to accommodate various implements and/or holsters 402.

An example dock assembly 300, as shown in FIGS. 3-8, includes one or more dock units 100, which may be mounted individually or in groups as desired. As shown in FIGS. 1-8, a dock unit 100 includes a substantially planar hard mount component (or body) 102 arranged to receive and to support an implement or an implement holster 402, and a mounting portion 104 which includes one or more mounting holes 106. The mounting portion 104 may be integral to the body 102 or coupled to the body 102. In one embodiment, the dock unit 100 is molded (e.g., injection molded) or formed as a single piece, including the body 102 and the mounting portion 104.

In various embodiments, different dock units 100 may be formed having different dimensions to accommodate different (particular or generic) implements or implement holsters 402. For instance, the body 102 may have a different size or shape, the mounting portion 104 may have a different size or shape, and the offset or attachment configuration of the mounting portion 104 to the body 102 may be different in size, shape, or angle of attachment, to accommodate the different implements or implement holsters 402. Various combinations of the same are contemplated as within the scope of this disclosure.

In an implementation, the mounting portion 104 may have at least one substantially planar surface for mating against a desired structurally sound mounting surface (such as a vehicle console, wall, desk, bed frame, etc.). The dock unit 100 is mounted to the mounting surface via the mounting portion 104 using permanent or temporary fasteners (such as screws or bolts, for example) through the holes 106 and into the mounting surface. In various implementations, the dock unit 100 may include one or more of the holes 106, which may be disposed in various arrangements to facilitate mounting and provide stability. Further, the hole(s) 106 may have varying shapes (circular, oval, keyhole, polygonal, etc.) to accommodate various mounting hardware and configurations. In alternate embodiments, the dock unit 100 may be mounted to the mounting surface using other techniques, such as adhesive, specially formed mating surfaces (e.g., tongue in groove, rails, etc.), or the like. Dock units 100 may be mounted to a mounting surface in any orientation desirable (e.g., horizontally, vertically, diagonally, etc.).

In an implementation, the mounting portion 104 is offset relative to the body 102 and is arranged to form a predetermined space between the body 102 and the desired mounting surface due to the offset. The predetermined space can be sized (based on a predetermined offset) to fit a particular holster 402, a generic holster, or the like, between the dock unit 100 or dock assembly 300 and the desired mounting surface (e.g., wall, desk surface, car interior, etc.). In alternate embodiments, the dock unit 100 may have different offsets, for example, for different applications.

Once one or more dock units 100 are mounted to the mounting surface, the dock unit 100 or the dock assembly 300 (i.e., a group of more than one dock unit 100) may be used to temporarily or permanently support an implement holster 402, as shown in FIGS. 3-8, or other types of cases, or any type of implement. The holster 402, or the like, may be slid behind (see FIGS. 4A-8) the dock units 100, with the belt clips 404 of the holster 402 clipped to the dock units 100. Alternately, the holster 402 may be slid in front of the dock units 100, with the belt clips 404 clipped to the dock units 100 in an opposite direction. Belt clips 404 on the holster 402 are slid over the body 102 of the dock units 100, and clipped into place on the body 102 of the dock units 100 (see FIGS. 6A and 6B).

Figure 6A:
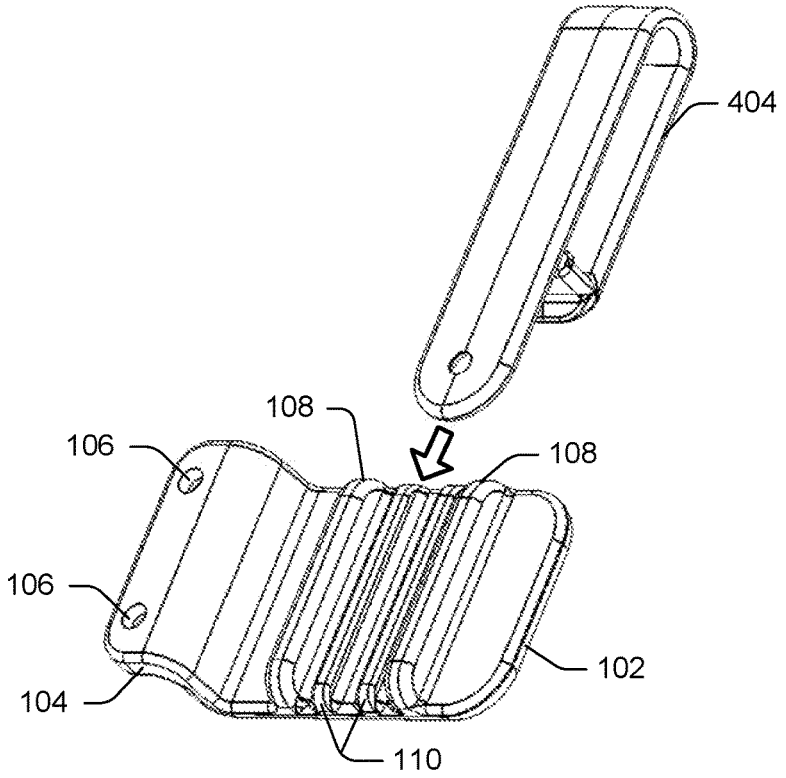
FIG. 6A shows a back perspective view of a holster clip being mounted to an example dock unit, according to an embodiment.
Figure 6B:
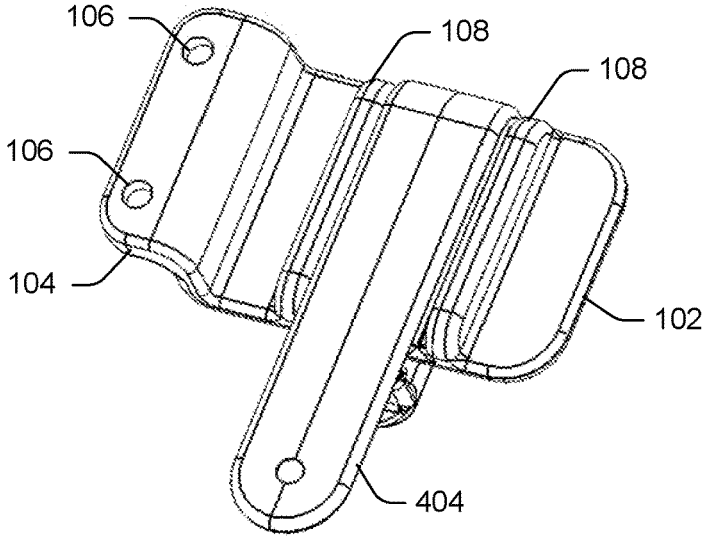
FIG. 6B shows a back perspective view of the holster clip as mounted to the example dock unit, according to an embodiment.

In various implementations, as shown in FIGS. 1A-3B, each dock unit 100 includes two guide ridges 108 and/or one or more spacing ridges 110. When a belt clip 404 is slid onto the body 102 of the dock unit 100 (as shown in FIGS. 6A and 6B for example), the guide ridges 108 provide a guide for the clip 404 to locate onto a desired portion of the body 102 of the dock unit 100 (for stability, etc.). In an embodiment, the clip 404 is disposed adjacent to the one or more guide ridges 108 when the clip 404 is mounted to the body 102. The guide ridges 108 prevent the clip 404 from moving around on the dock unit 100 once mounted. For example, the clip 404 is prevented from moving laterally across the body 102, since the guide ridges 108 hold the clip 404 in position on the body 102.

In an implementation, as shown in FIGS. 1A-3B, the guide ridges 108 comprise raised portions that are coupled to the body 102 or are integral to the body 102. For example, the guide ridges 108 can be molded or formed with the molding or forming of the body 102. In an alternate embodiment, guide ridges 108 can be fastened to the body 102 in desired location(s). Alternately, the guide ridges 108 can comprise other features coupled to or integral to the body 102 that are arranged to guide and/or hold the clip 404 in place on the body 102. For instance, the body may include one or more grooves, or similar features, where the sides or walls of the grooves comprise the guide ridges 108. In various implementations, other features may also comprise guide ridges 108.

As shown in FIGS. 1A-3B, one or more spacing ridges 110 may be disposed between the guide ridges 108. Alternately, the spacing ridges 110 may be disposed on a separate surface of the body 102. In an embodiment, the spacing ridge(s) 110 make contact or nearly make contact with an inside surface of the clip 404 when the clip 404 is mounted to the body 102 of the dock unit 100. In the embodiment, the one or more spacing ridges 110 allow the clip 404 to be mounted tightly to the body 102, by taking up any gap or space between the body 102 and the clip 404. This provides added stability, including when withdrawing and re-holstering the implement while the holster 402 is docked on the dock assembly 300 or dock unit 100.

In various implementations, the spacing ridges 110 comprise various features having various shapes, profiles, and dimensions arranged to decrease space or gap between the clip 404 and the body 102 of the dock unit 100. For instance, the spacing ridge 110 can comprise any raised feature (circular, elongated, polygonal, prism, irregular, decorative, etc.) on a surface of the body 102, and may be disposed between two of the guide ridges 108. As shown in FIGS. 1A-3B, the spacing ridges 110 (and/or the guide ridges 108) can have a length equal to the approximate width of the body 102. In other embodiments, the spacing ridges 110 (and/or the guide ridges 108) can have a length less than or greater than the width of the body 102.

In the various implementations, the spacing ridges 110 are coupled to or are integral to the body 102. For instance, the spacing ridges 110 may be formed or molded with the body 102 of the dock unit 100. Alternately, the spacing ridges 110 (and/or the guide ridges 108) may be comprised of a different material than the body 102. Further the spacing ridges 110 (and/or the guide ridges 108) may be coupled to the body with adhesive, permanent or temporary fasteners, or the like.

Figure 3A:
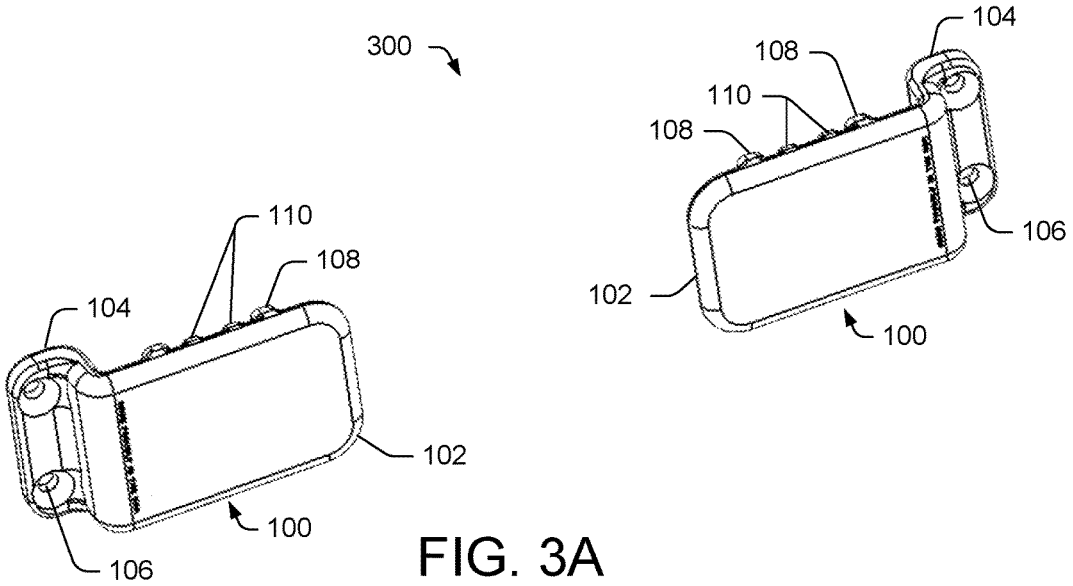
FIG. 3A shows a front (outside) perspective view of an example dock assembly, according to an embodiment.
Figure 3B:
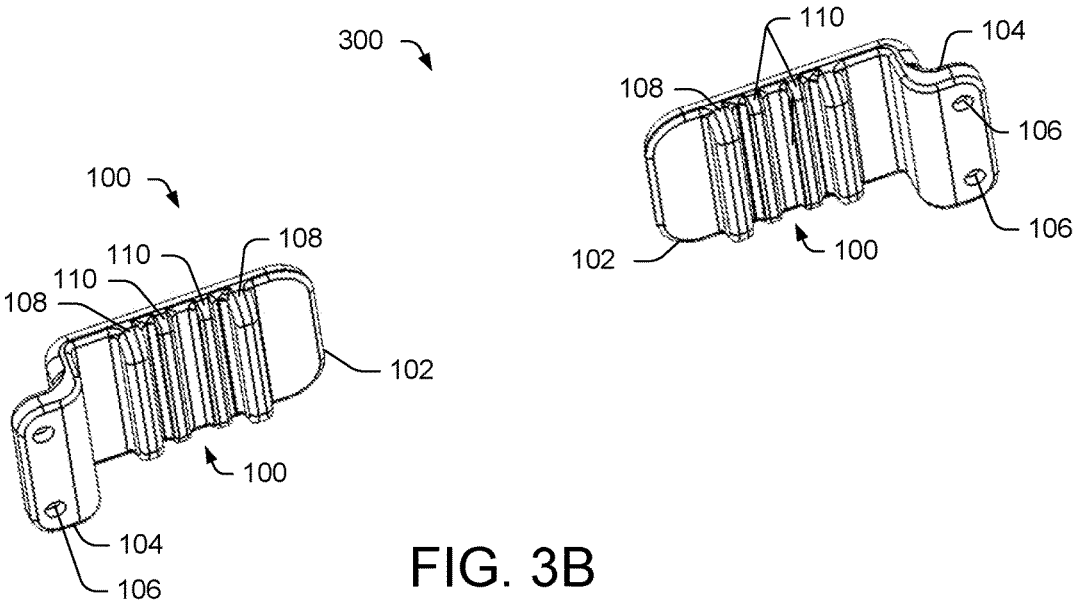
FIG. 3B shows a back (inside) perspective view of the example dock assembly of FIG. 3A, according to an embodiment.
Figure 4A:
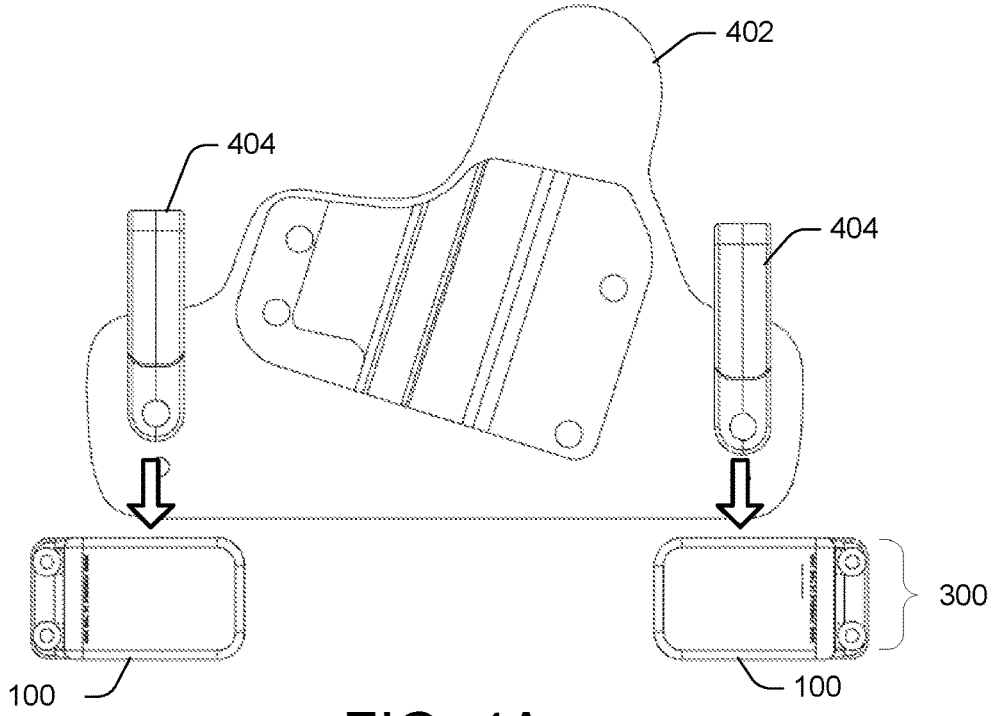
FIG. 4A shows a front view of a holster being mounted to an example dock assembly, according to an embodiment.
Figure 4B:
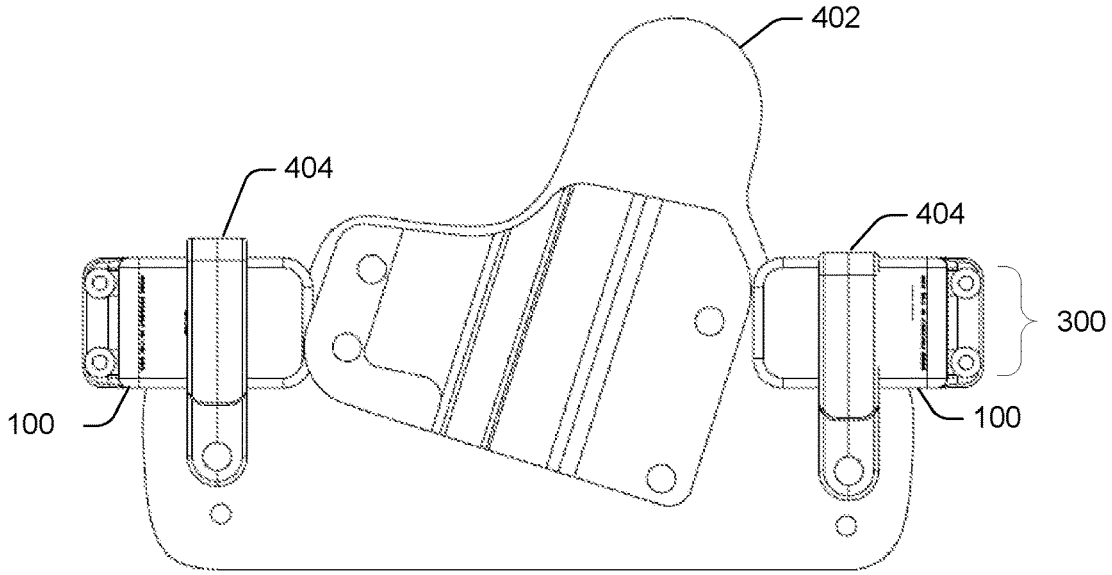
FIG. 4B shows a front view of the holster as mounted to the example dock assembly, according to an embodiment.
Figure 5A:
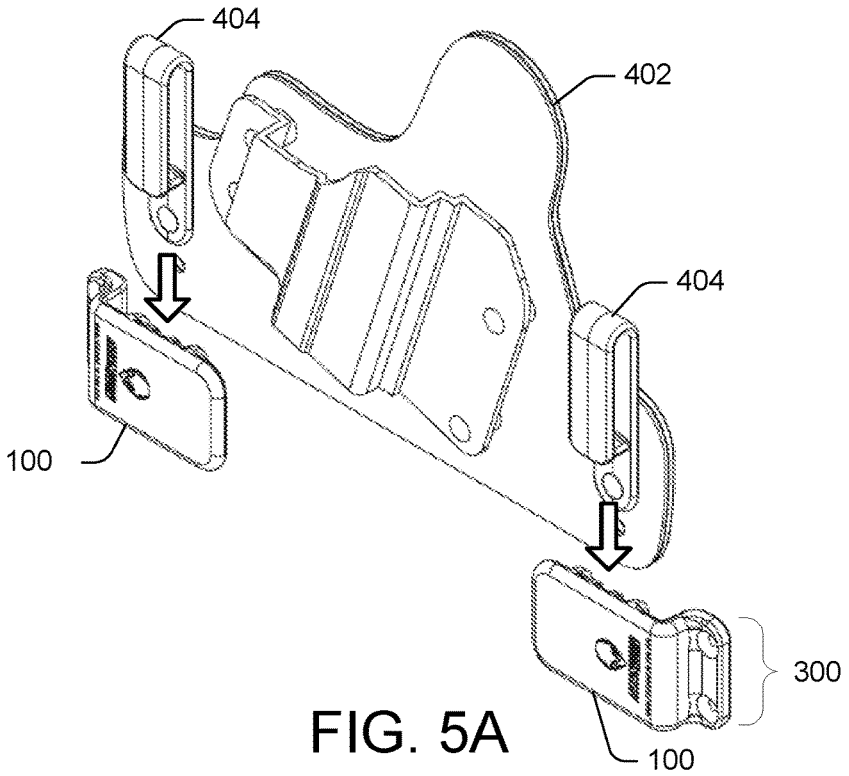
FIG. 5A shows a front perspective view of a holster being mounted to an example dock assembly, according to an embodiment.
Figure 5B:
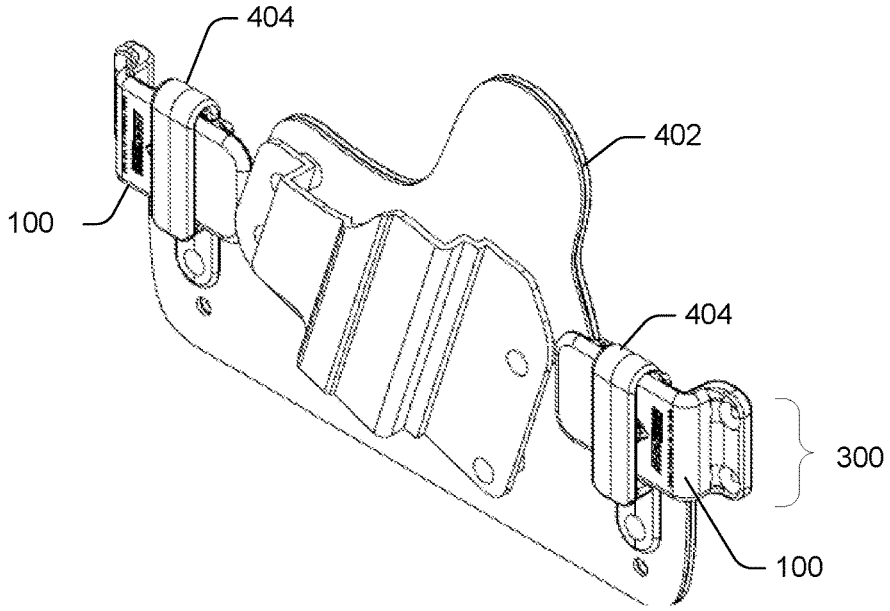
FIG. 5B shows a front perspective view of the holster as mounted to the example dock assembly, according to an embodiment.

In various implementations, dock units 100 may be mounted in groups (as shown in FIGS. 3A and 3B) to form dock assemblies 300. Dock assemblies 300 may include two or more dock units 100. The dock units 100 may be mounted in any orientation desired: with the mounting portions 104 toward each other, away from each other, at a predetermined angle with respect to each other, and so forth. As shown in FIGS. 4A-5B, the dock units 100 can be mounted at a desired distance from each other, and in a desired orientation with respect to each other (e.g., in line and horizontally oriented) to allow a particular holster to be mounted to the dock assembly 300, with clips 404 of the holster 402 clipped to dock units 100. The mounting distance and orientation of the dock units 100 can be altered to accommodate other holsters, cases, implements, and the like.

As shown in FIGS. 4A-5B, the holster 402 (or the like) can be mounted to the inside (or back) of the dock assembly 300, with the clips 404 mounted over the dock units 100 (as shown at FIGS. 6A and 6B). Alternately, the holster 402 (or the like) can be mounted to the outside (or front) of the dock assembly 300, with the clips 404 mounted over the dock units 100 (similar to FIGS. 6A and 6B). The first (inside) or second (outside) configurations (or another configuration) may be desirable based on the mounting location for the dock assembly 300, including the convenience of mounting the holster 402 or implement to the dock assembly 300. Additionally, one of the first or second configurations may be more desirable based on the ability to withdraw the implement from the holster 402 while the holster 402 is mounted to the dock assembly 300.

Figure 7A:
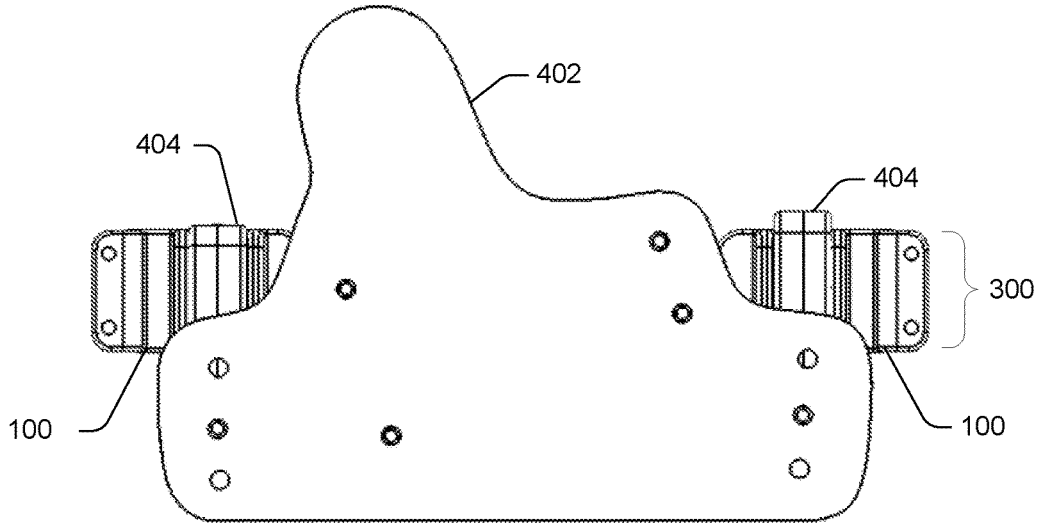
FIG. 7A shows a back view of a holster as mounted to an example dock assembly, according to an embodiment.
Figure 7B:
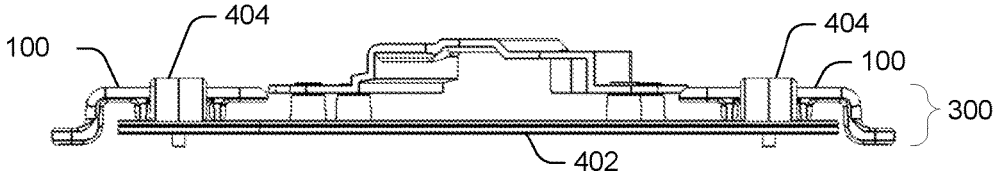
FIG. 7B shows a top view of the holster as mounted to the example dock assembly, according to an embodiment.
Figure 8:
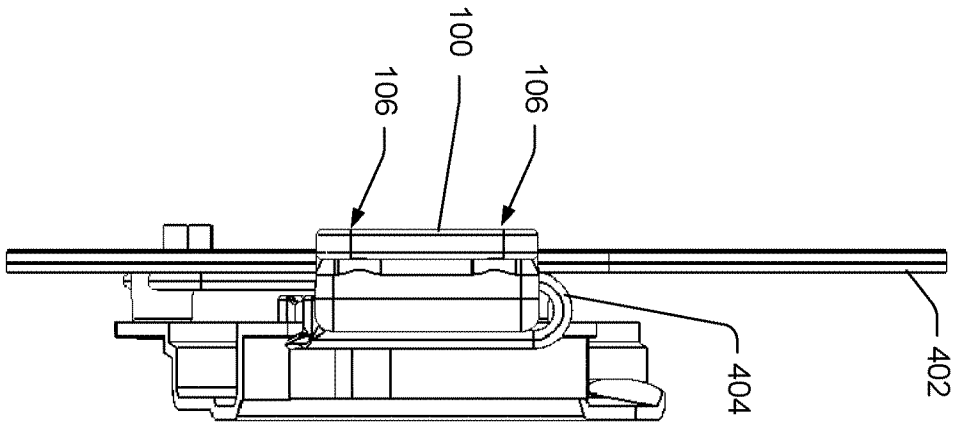
FIG. 8 shows a side view of the holster as mounted to the example dock assembly of FIG. 7A, according to an embodiment.

FIGS. 6A and 6B show the clip 404 in the process of being mounted (FIG. 6A) and fully mounted (FIG. 6B) to the body 102 of the dock unit 100, so that the clip 404 is located between the guide ridges 108. With the guide ridges 108 on either side of the clip 404, the clip 404 is securely held in the desired position on the body 102. The inside surface of the clip 404 is contacting or nearly contacting the spacing ridges 110 when mounted to the body 102 of the dock unit 100. This close contact ensures stability of the clip 404 on the dock unit 100, including when holstering and withdrawing an implement from a holster 402 mounted to the dock assembly 300. FIGS. 7A, 7B, and 8 show additional views of the holster 402 mounted to the dock assembly, for clarity of the implementation.

In various implementations, the dock unit 100 is comprised of various plastics, composites, metals, combinations of the same, or the like. For example, the dock unit 100 may be comprised of a polyamide, or similar material. The use of a molded polyamide or fiber-filled polyimide provides a dock unit 100 that is rigid and stable for drawing and re-holstering the implement while mounted in the dock unit 100 or dock assembly 300, for instance. In various embodiments, the dock unit 100 has stability properties based on a particular material selected for the dock unit 100. For example, some materials that may be used include nylons, aramids, styrenic block copolymers (TPE-s), polyolefin blends (TPE-o), elastomeric alloys (TPE-v or TPV), thermoplastic polyurethanes (TPU), thermoplastic co-polyesters, thermoplastic polyamides, combinations of the same, and the like. Additionally, in some embodiments, the stability properties are also based on a thickness of the dock unit 100.

The techniques, components, and devices described herein with respect to the implementations are not limited to the illustrations of FIGS. 1A-8, and may be applied to other docks, holster devices, and case designs, without departing from the scope of the disclosure. In some cases, additional or alternative components, techniques, sequences, or processes may be used to implement the techniques described herein. Further, the components and/or techniques may be arranged and/or combined in various combinations, while resulting in similar or approximately identical results. It is to be understood that a dock unit 100 or a dock assembly 300 may be implemented as a stand-alone device or as part of another system (e.g., integrated with other components). In various implementations, additional or alternative components may be used to accomplish the disclosed techniques and arrangements.

Although various implementations and examples are discussed herein, further implementations and examples may be possible by combining the features and elements of individual implementations and examples.

CONCLUSION

Although the implementations of the disclosure have been described in language specific to structural features and/or methodological acts, it is to be understood that the implementations are not necessarily limited to the specific features or acts described. Rather, the specific features and acts are disclosed as representative forms of implementing the claims.

The invention claimed is:

1. A dock apparatus, comprising:

a planar hard mount component comprising a single rigid plane arranged to receive and to support an implement holster;

two guide ridges disposed on and protruding from a first surface of the hard mount component; each having a length that extends along a first axis of the plane and arranged to guide a clip portion of the implement holster onto a desired portion of the hard mount component along the first axis of the plane, and to prevent the clip portion of the implement holster from undesirably moving on the hard mount component once mounted, the guide ridges arranged to abut the clip portion of the implement holster while the clip portion of the implement holster is mounted to the hard mount component;

a mounting portion comprising a rigid tab integral to or coupled to the hard mount component arranged to temporarily or permanently mount the dock apparatus to a desired surface; and two or more spacing ridges disposed between the two guide ridges and arranged to reduce or eliminate a gap between the hard mount component and the clip portion of the implement holster when the clip is held between the guide ridges, wherein the guide ridges protrude farther from the hard mount component than the spacing ridges.

2. The dock apparatus of claim 1, wherein the one or more spacing ridges are integral to of the hard mount component.

3. The dock apparatus of claim 1, wherein the one or more spacing ridges make contact with an inside surface of the clip portion of the implement holster when the clip portion of the implement holster is mounted to the hard mount component.

4. The dock apparatus of claim 1, wherein the second surface comprises the first surface.

5. The dock apparatus of claim 1, the mounting portion further comprising a planar mounting surface and one or more mounting holes arranged to temporarily or permanently couple the dock apparatus to the desired surface.

6. The dock apparatus of claim 1, wherein the one or more guide ridges are integral to the first surface of the hard mount component.

7. The dock apparatus of claim 1, wherein the one or more guide ridges comprise raised portions that are coupled to the hard mount component or integral to the hard mount component.

8. The dock apparatus of claim 1, wherein the clip portion of the implement holster comprises a belt clip coupled to the implement holster.

9. The dock apparatus of claim 1, wherein the mounting portion is integral to or coupled to the hard mount component at a predetermined offset to form a predetermined space between the hard mount component and the desired surface.

10. A mounting dock assembly, comprising:

one or more dock units, each dock unit including:

a planar hard mount component comprising a single rigid plane arranged to receive and to support an implement or an implement holster;

two guide ridges integral to the hard mount component and having a length that extends along a first axis of the plane, and arranged to guide a clip of the implement or the implement holster onto a desired portion of the hard mount component and to abut the clip of the implement or the implement holster to prevent the clip from undesirably moving on the hard mount component once mounted;

two or more spacing ridges located between the two guide ridges and integral to the hard mount component and arranged to reduce or eliminate a gap between the hard mount component and the clip when the clip is held between the guide ridges, wherein the guide ridges protrude farther from the hard mount component than the spacing ridges; and a mounting portion comprising a rigid tab including a substantially planar mounting surface and one or more mounting holes adapted to temporarily or permanently mount the dock unit to a desired surface.

11. The mounting dock assembly of claim 10, wherein the mounting dock assembly comprises two dock units mounted on a mounting surface a predetermined distance from each other such that a preselected edge perpendicular to the first axis of a first hard mount component of a first dock unit of the two dock units is aligned with an equivalent edge of a second hard mount component of a second dock unit of the two dock units.

12. The mounting dock assembly of claim 11, wherein the implement or the implement holster includes two clips and wherein each of the two dock units is oriented to receive a clip of the implement or the implement holster to support the implement or the implement holster together.

13. The mounting dock assembly of claim 10, wherein the one or more dock units are arranged to receive and to support the implement or the implement holster in a first configuration with the implement or the implement holster facing an inside surface of the one or more dock units while mounted to the one or more dock units, and in a second configuration with the implement or the implement holster facing an outside surface opposite the inside surface of the one or more dock units while mounted to the one or more dock units.

14. A mounting dock assembly, comprising:

a pair of dock units, each dock unit including:

a single, flat, rigid hard mount component arranged to receive and to support a belt clip of a firearm holster;

two or more guide ridges integral to a surface of the hard mount component and arranged to guide the belt clip of the firearm holster onto a desired portion of the hard mount component and to abut the belt clip once mounted;

two or more spacing ridges integral to the surface of the hard mount component and disposed between two of the two or more guide ridges and arranged to reduce or eliminate a gap between the hard mount component and the belt clip when the clip is held between the guide ridges, wherein the guide ridges protrude farther from the hard mount component than the spacing ridges; and a mounting portion integral to the hard mount component and including a substantially planar mounting surface and one or more mounting holes for temporarily or permanently coupling the dock unit to a desired mounting surface.

15. The mounting dock assembly of claim 14, wherein the mounting portion is offset relative to the hard mount component and is arranged to form a predetermined space between the hard mount component and the desired mounting surface equal to or greater than a thickness of a backer of the firearm holster due to the offset.

* * * * *